US010959556B1

(12) United States Patent
Manos

(10) Patent No.: US 10,959,556 B1
(45) Date of Patent: Mar. 30, 2021

(54) TRAY UTENSIL WITH RECEPTACLES, PACKAGE OF TRAY UTENSILS AND METHOD

(71) Applicant: Gregory C Manos, Riverside, CA (US)

(72) Inventor: Gregory C Manos, Riverside, CA (US)

( * ) Notice: Subject to any disclaimer, the term of this patent is extended or adjusted under 35 U.S.C. 154(b) by 93 days.

(21) Appl. No.: 16/154,140

(22) Filed: Oct. 8, 2018

(51) Int. Cl.
*A47G 23/06* (2006.01)
*B65D 1/36* (2006.01)

(52) U.S. Cl.
CPC ..... *A47G 23/0633* (2013.01); *B65D 1/36* (2013.01)

(58) Field of Classification Search
CPC ..... A47G 23/0633; B65D 1/36
USPC ..... 206/561, 562, 563, 565, 564, 557, 549, 206/541; 220/556, 575, 574
See application file for complete search history.

(56) References Cited

U.S. PATENT DOCUMENTS 1,885,483 A * 11/1932 Samuelson ..... A47G 23/06 206/553
3,498,470 A * 3/1970 Thomas ..... A47G 23/06 211/74
4,516,685 A 5/1985 French
D336,187 S 6/1993 Van Den Kieboom
D336,217 S 6/1993 Picozza
D336,407 S 6/1993 Harding
5,381,901 A * 1/1995 Hundley ..... B65D 1/36 206/457
5,429,231 A * 7/1995 McSpadden ..... A47G 19/065 206/217
5,497,885 A * 3/1996 Sussman ..... A47G 19/065 206/217
D393,181 S 4/1998 Panta
D398,480 S 9/1998 Panta Chica
5,803,305 A * 9/1998 Perlis ..... A47G 19/065 206/558
6,036,020 A * 3/2000 Distler ..... A47G 23/06 206/217
6,149,027 A * 11/2000 Rathjen ..... A47G 19/06 220/23.83
6,264,026 B1 * 7/2001 Bradley ..... A47G 19/065 206/217
D469,310 S 1/2003 Burkowski
6,883,692 B2 * 4/2005 Harden ..... B60N 3/002 206/563
D572,536 S 7/2008 Cox
D573,407 S 7/2008 Cox
7,874,449 B1 * 1/2011 Studee ..... B65D 47/261 220/502
D654,764 S 2/2012 Murphy
D706,583 S 6/2014 Clark
D729,588 S 5/2015 Breton
(Continued)

OTHER PUBLICATIONS

U.S. Appl. No. 29/640,320, filed Mar. 2018, Manos, Gregory.
U.S. Appl. No. 62/640,564, filed Mar. 2018, Manos, Gregory.
U.S. Appl. No. 29/646,518, filed May 2018, Manos, Gregory.

*Primary Examiner* — J. Gregory Pickett
*Assistant Examiner* — Jenine Pagan
(74) *Attorney, Agent, or Firm* — John J. Connors; Connors & Assoc. pc

(57) ABSTRACT

Tray utensils of identical dimensions are stacked into an assembly and wrapped within a transparent package displaying a visual image of a tray utensil holding within a tray receptacle a standard beverage can upright generally vertically while the tray is oriented generally horizontally and used to hold selected hors d'oeuvres.

6 Claims, 6 Drawing Sheets

(56) References Cited

U.S. PATENT DOCUMENTS

| | | | | |
|---|---|---|---|---|
| D732,344 | S | 6/2015 | Clark | |
| 9,220,337 | B1 * | 12/2015 | Wenzel | A47B 13/021 |
| D786,621 | S | 5/2017 | Davis | |
| D791,544 | S | 7/2017 | Dennis | |
| D793,812 | S | 8/2017 | Dennis | |
| D809,232 | S | 1/2018 | Wu | |
| 2008/0217206 | A1 * | 9/2008 | Shen | A47G 19/06<br>206/562 |
| 2011/0132914 | A1 * | 6/2011 | Vernes | A47G 19/06<br>220/575 |

* cited by examiner

10
M
R
RM
14c
LBM
TSW2
TSW3
LBM
TSW2

10
R
RM
TSW3
LBM
TSW1
14a
14c
R
TSW3
RM
h1
LBM

SBC
LD
RM
IND
A
G
TSW2
TSW3
LBM
BW

10
M
R
d
h2
h3
A
LBM
14a
16
26c
14c
8A
SBC
A
TSW2
TSW3
LD
B
R
M
RM
ED2
LBM

TRAY UTENSIL WITH RECEPTACLES, PACKAGE OF TRAY UTENSILS AND METHOD

RELATED PATENT APPLICATIONS & INCORPORATION BY REFERENCE

Any and all U.S. patents, U.S. patent applications, and other documents, hard copy or electronic, cited or referred to in this application are incorporated herein by reference and made a part of this application, including my pending U.S. Provisional Patent Application No. 62/640,564, entitled "Hors D'Oeuvre Tray and Method," filed Mar. 8, 2018. This non-provisional utility patent application is an improvement in the tray disclosed in this co-pending provisional patent application No. 62/640,564.

DEFINITIONS

The words "comprising," "having," "containing," "holding," and "including," and other grammatical forms thereof, are intended to be equivalent in meaning and be open ended in that an item or items following any one of these words is not meant to be an exhaustive listing of such item or items, nor meant to be limited to only the listed item or items.

The word "rectangular " includes square.

The word "standard beverage can" means a conventional 12 ounce (oz.) can, or a conventional 16 oz. bottle. Currently both the conventional 12 oz. can and the conventional 16 oz. bottle have the same diameter, which is nominally 2.5 inches.

BACKGROUND

Eating hors d'oeuvres can be a messy business. Partygoers are faced with the challenge of selecting with one hand a few desired hors d'oeuvres from a display of a variety of solid and liquid-like hors d'oeuvres while holding with their other hand a cup, bottle or can of beverage. Partygoers typically hold a plate in one hand, placing solid hors d'oeuvres such as, for example, chips, crackers, bite-sized pieces of solid food, etc. on the plate being held. If they are holding a cup of beverage in the other hand, they must place the cup down or the plate down on, for example, a horizontal tabletop. Any liquid-like hors d'oeuvres placed on the plate can flow over the plate's surface and mingle and soak into nearby solid hors d'oeuvres on the plate.

SUMMARY

My utensil is a lightweight, portable, reusable, and disposable tray that holds solid and liquid-like hors d'oeuvres and a standard beverage can. It is inexpensive to make using a plastic material and conventional manufacturing techniques. My tray utensils are stackable and assembled into a novel package with instructions for using according to my method. My tray utensil is designed to retain a standard beverage can upright vertically in an inboard receptacle that is integral with the body of the tray. A user may now hold with one hand this tray utensil and standard beverage can combination generally horizontally and place hors d'oeuvres into my tray utensil with the other hand while maintaining the standard beverage can generally vertically orientated.

My tray utensil's features are depicted in the embodiment discussed in the section entitled "DETAILED DESCRIPTION OF ONE ILLUSTRATIVE EMBODIMENT." These features are not listed in any rank order nor is this list intended to be exhaustive. The claims that follow define my tray utensil, package, and method, distinguishing them from the prior art; however, without limiting the scope of my tray utensil, package, and method as expressed by these claims, in general terms, some, but not necessarily all, of their features are:

One, my utensil for holding hors d'oeuvres includes a tray member having a sunken section in which hors d'oeuvres are deposited. The sunken section is formed by a sidewall, and integral with the sidewall at least one receptacle.

Two, the receptacle includes a lower body member configured to hold a standard beverage can upright generally vertically while the tray utensil is oriented generally horizontally.

Three, the lower body member comprises an inwardly tapering, sidewall at least half of which is formed from the sidewall of the sunken section.

Four, the receptacle may include a cylindrical rim member terminating at an outer circular edge as an open mouth and at an inner edge in a circular ledge connected to an upper edge of the tapering sidewall. The ledge has a circular perimeter with a diameter less than the diameter of the circular diameter of the rim member and greater than the standard beverage can's diameter. For example, the rim member comprises a cylindrical wall with a height ranging from ¼ to ¾ of an inch, and the sidewall has a height ranging from ¾ to 1.25 inches and is tapered at an angle from ½ to 3 degrees. The open mouth has a diameter greater than 2.5 inches. The depth of the receptacle is established by the height of the cylindrical wall and the depth of the lower body member, and is at least 2 inches and ranges from 2 to 2.5 inches.

Five, the tray member is a rigid structure and may have a generally rectangular shape, and a plurality of my utensils are configured to be stacked one upon the other into an assembly. Such a rectangular tray member has a central longitudinal reference line, two pairs of opposed sides, and an enlarged, sunken, rectangular, section in which hors d'oeuvres are deposited. The rectangular tray member has opposed sides of equal length, and a thin rectangular perimeter member along an upper edge of the sunken rectangular central section surrounds at least partially the sunken rectangular central section.

Six, in one embodiment a pair of receptacles are employed that may be formed in the rectangular member integral therewith, one in each of opposed sides of the rectangular section. Each receptacle of the pair has an open mouth and each receptacle is at an edge of the rectangular perimeter member and is elevated the same distance above the rectangular perimeter member so that the open mouths of the receptacles lie in a single reference plane. The pair of receptacles may have the same dimensions.

Seven, a side of the tray member and a portion of a lower body member of a receptacle are adjacent and each have opposed and inwardly tapering sidewalls. The sidewalls merge into a common upper edge configured as a portion of a circle, and are concentric to form between them an arch shaped groove separating the sunken section from the receptacle. The inwardly tapering sidewall of the sunken section and the inwardly tapering truncated conical sidewall of the receptacle's lower body member are opposed to form between them a groove separating the sunken section from the receptacle. This groove has in cross-section an arch shape.

Eight, the inwardly tapering sidewall of the sunken section and the inwardly tapering truncated conical sidewall of the receptacle's lower body member and the circular indentation are all concentric around a center lying along a central longitudinal reference line of the rectangular tray member.

Nine, my utensil is a unitary structure. It may be made entirely from plastic with the tray member and the receptacle being integral.

My package includes an assembly of my utensils for holding hors d'oeuvres stacked together one on top of the other within a transparent packaging. Displayed on the package is a visual image of a tray member holding in a receptacle a standard beverage can upright generally vertically while the tray member is oriented horizontally. For example, resting on the topmost tray member of the stack is an instruction sheet within the transparent packaging positioned to be viewed by a user prior to unwarping the packaging.

My method of serving hors d'oeuvres comprises the following steps:

(a) while holding a utensil member having a sunken section in which hors d'oeuvres are deposited, and integral with a sidewall of the sunken section at least one receptacle having an open mouth, said receptacle being configured to hold a standard beverage can firmly upright generally vertically while the tray member is oriented horizontally, and (b) prior to depositing selected hors d'oeuvres into the sunken section, placing a standard beverage can into said open mouth and pushing said can into the receptacle.

DESCRIPTION OF THE DRAWING

One embodiment of my utensil and method is discussed in detail in connection with the accompanying drawing, which is for illustrative purposes only. This drawing includes the following figures (Figs.), with like numerals and letters indicating like parts.

DETAILED DESCRIPTION OF ONE ILLUSTRATIVE EMBODIMENT

General

Figure 1:
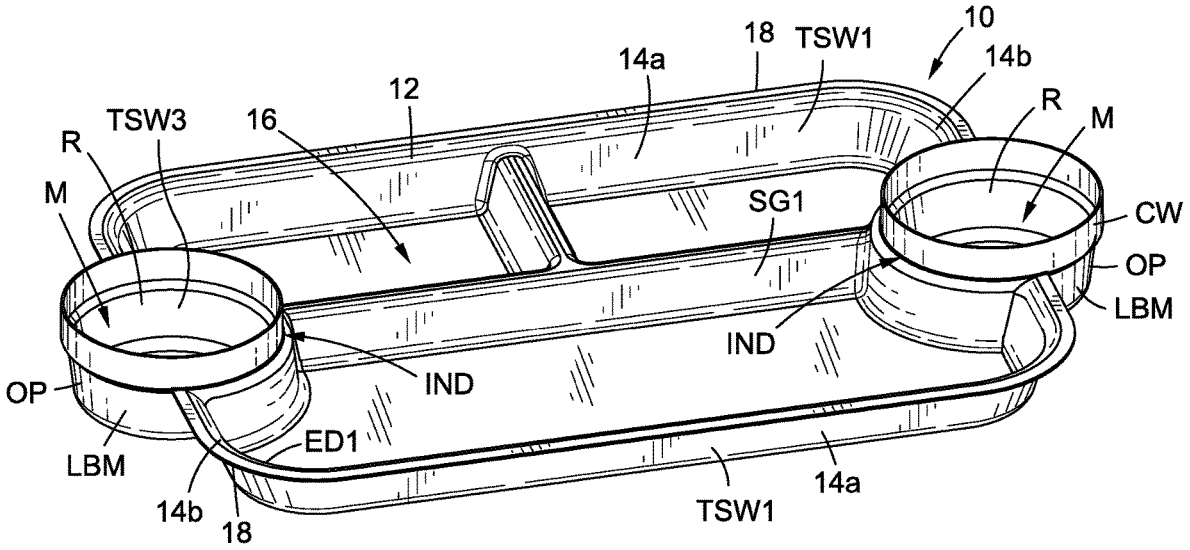
FIG. 1 is a perspective view of one embodiment of my tray utensil.
Figure 1A:
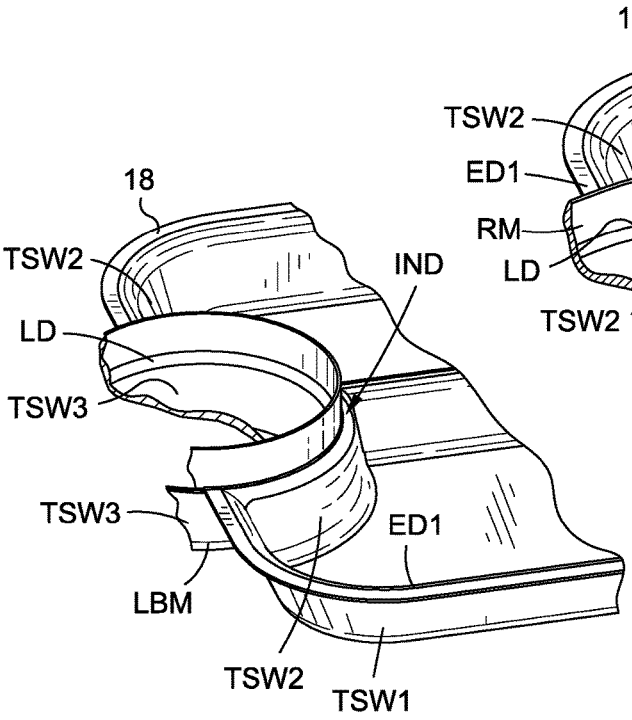
FIG. 1A is a perspective view like FIG. 1 of a fragmentary portion of my utensil depicting its receptacle with sections broken away.
Figures 6, 7, 8, 8A:
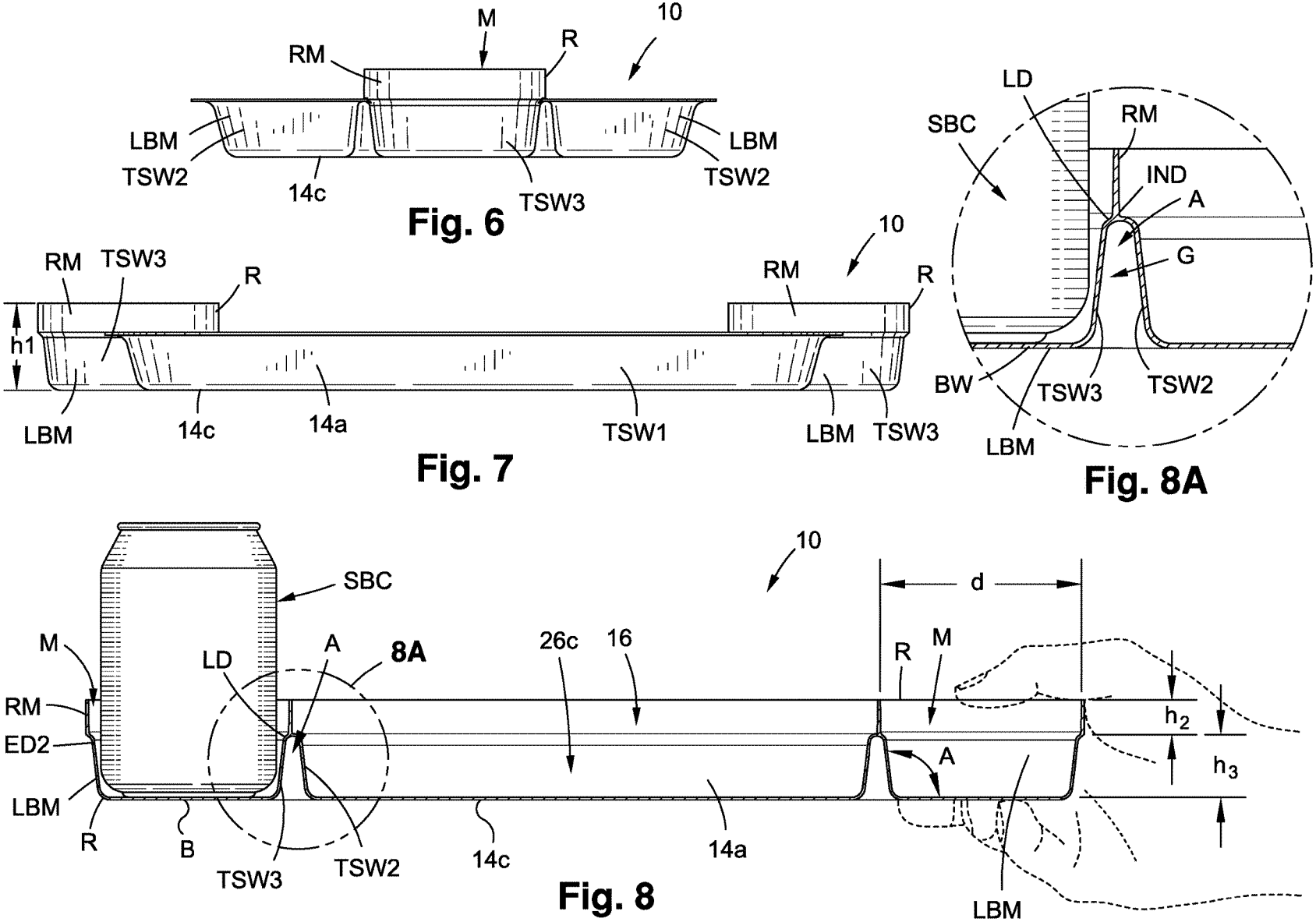
FIG. 6 is a left side elevation view of my tray utensil shown in FIG. 14.
FIG. 7 is a back elevation view of my tray utensil shown in FIG. 14.
FIG. 8 is a cross-sectional view taken along line 8-8 of FIG. 2, showing a standard beverage can seated in a receptacle of my tray utensil shown in FIG. 1.
FIG. 8A is an enlarged fragmentary cross-sectional view taken along line 8A of FIG. 8.
Figure 10:
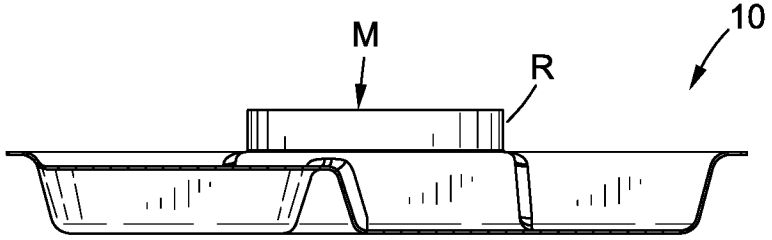
FIG. 10 is a cross-sectional view taken along line 10-10 of FIG. 2.

As best shown in FIGS. 1 and 8, my tray utensil 10 includes at least one inboard side receptacle R sized to receive a standard beverage can SBC. In the embodiment depicted a pair of receptacles R are employed. Typically at least one receptacle R is used to retain a standard beverage can SBC. As shown in FIG. 8, while holding my tray utensil 10 with one hand and a standard beverage can SBC retained in one receptacle R, a user selects from a display hors d'oeuvres (not shown, some of which may be solid and others liquid-like) and deposits the selected hors d'oeuvres onto the tray utensil 10. The tray utensil 10 may comprise a pair of aligned receptacles R on opposed sides of a rectangular tray member 12 for holding hors d'oeuvres deposited therein. As illustrated in FIG. 8, in this embodiment each side receptacle R has the same shape and depth configured to maintain a standard beverage can SBC upright generally vertically at a right angle when a lower portion of the can is seated in a receptacle R of the tray utensil 10 that is in a generally horizontally orientation. The tray utensil 10 is a unitary, integral, one-piece structure made, for example, entirely from a plastic such as, for example, high impact polystyrene and its walls have a thickness ranging from 0.05 to 0.10 of an inch.

FIGS. 1 through 13

Figure 1B:
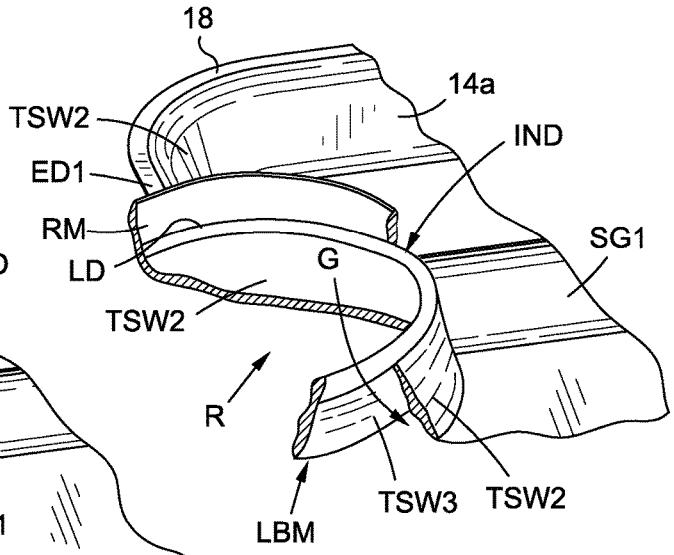
FIG. 1B is a perspective view like FIG. 1A of a fragmentary portion of my utensil depicting its receptacle with sections broken away to expose its opposed interior sidewalls.
Figure 2:
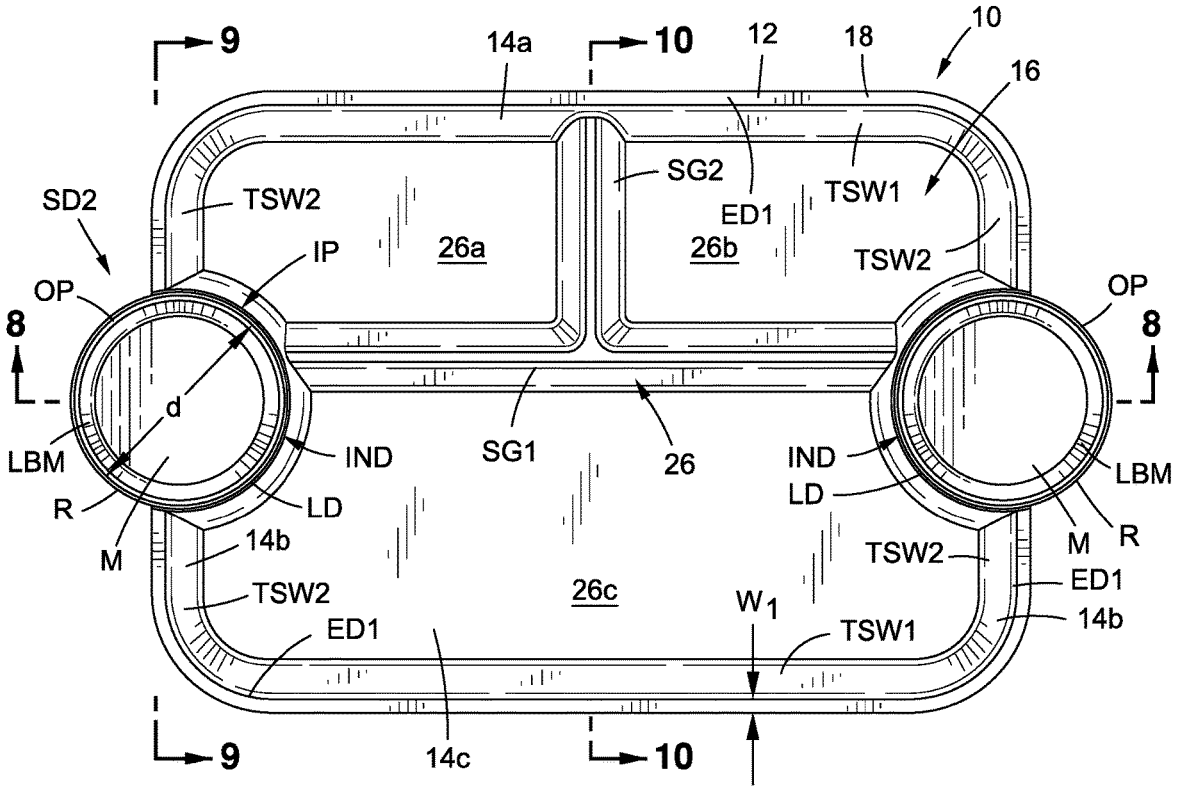
FIG. 2 is a top plan view of my tray utensil shown in FIG. 1.
Figure 2A:
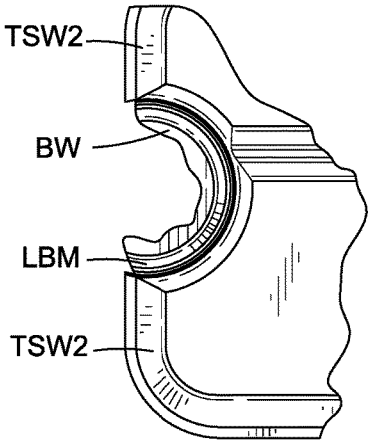
FIG. 2A is a top plan view like FIG. 2 of a fragmentary portion of my utensil depicting its receptacle with sections broken away.

As best shown in FIGS. 1 and 2, the tray utensil 10 comprises the rectangular tray member 12 for holding hors d'oeuvres deposited therein. The rectangular member 12 has a central longitudinal reference line RL (FIG. 4), one pair of opposed tapered sides 14*a* and another pair of opposed tapered sides 14*b*, and a bottom floor 14*c*. An enlarged, sunken, rectangular, central section 16 provides space in which hors d'oeuvres are deposited. In general the dimensions of the rectangular member 12 may be a width from 8 to 12 inches and a length from 8 to 12 inches. The central section 16 has a nominal depth of 1.00 inch, which may range from ¾ to 1.25 inch, but not exceeding 2.00 inches. As best depicted in FIG. 2, a generally thin, rectangular perimeter member 18 is along an upper edge of opposed inwardly tapering sidewalls TSW1 and TSW2 forming the sunken rectangular central section 16. The perimeter member 18 generally surrounds the central section 16, expect for portions of an upper edge ED1 (FIG. 1B) in which are formed the pair of the receptacles R. The width $W_1$ (FIG. 2) of the perimeter member 18 is from ¼ to ¾ of an inch, and its perimeter is defined by an upper edge ED1 of the inwardly tapering sidewall TSW1. At least a portion of this edge ED1 forms an indentation IND (FIG. 2) in the upper edge. This indentation IND is in the shape of a portion of a circle. The centers C of the partially circular indentations IND lie along the central longitudinal reference line RL.

A T-shaped divider member 26 partitions the sunken, central section 16 into three rectangular compartments 26*a*, 26*b*, and 26*c* (FIG. 2) for holding different types of hors d'oeuvres in the different compartments. The compartment 26*c* is the largest, taking up over fifty percent (50%) of the holding capacity of the sunken, central section 16. The compartments 26*a* and 26*b* have equal capacity and are each less than 25 percent (25%) of the holding capacity of the sunken, central section 16. A linear segment SG1 of the T-shaped divider member 26 is positioned lengthwise within the central section 16 between opposed sides of the pair 14*b* to form the food compartment 26*c* in one portion thereof. A linear segment SG2 of the T-shaped divider member 26 is centrally positioned and at a right angle to the linear segment SG1 to form on opposite sides of the segment SG2 the food compartments 26*a* and 26*b*. These food compartments 26*a* and 26*b* are of equal capacity. The linear segments SG1 and SG2 have the same heights that are equal to the depth of the central section 16 and that extend from the bottom floor 14*c* of the sunken central section 16 to the upper edge of this central section.

The compartments 26*a*, 26*b*, and 26*c* of my trays 10 are best suited to hold (a) fruits such as, for example, apples, oranges, and bananas, (b) vegetables such as, for example, celery, cucumbers, and carrots, and (c) solid snack foods such as, for example, potato chips, corn chips, and tortilla chips to name a few. The side receptacles R are specifically configured to retain upright as discussed above a standard beverage can SBC; however, it may hold a cup or liquid-like hors d'oeuvre such as, for example, dips and sauces like ranch and other dressings and vegetable and onion dips and flavored sauces like fruit, Bar-B-Q, Teriyaki, and Soy. The food items are to be dipped directly into the compartment or receptacles R holding them, keeping the food items separate and organized.

Figure 4:
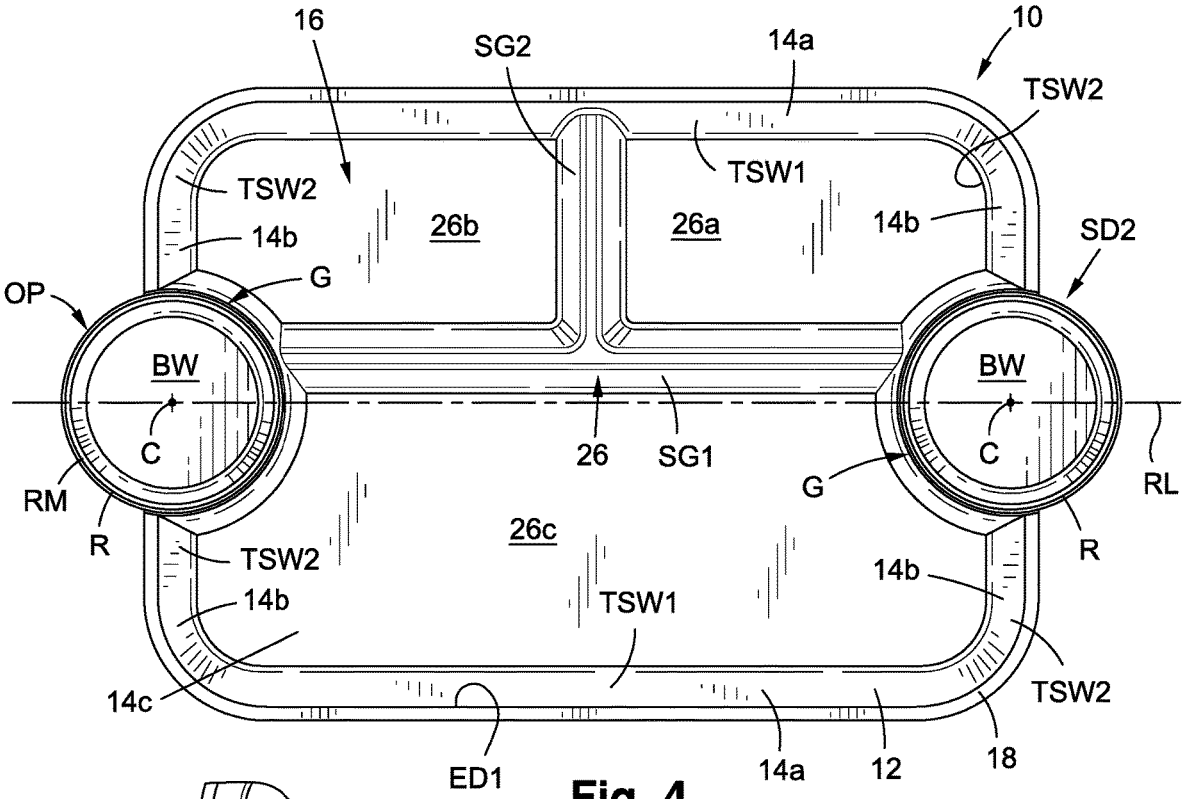
FIG. 4 is a bottom plan view of my tray utensil shown in FIG. 1.
Figure 4A:
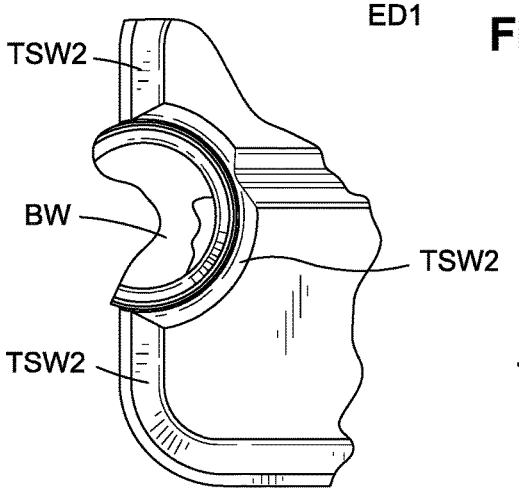
FIG. 4A is a bottom plan view like FIG. 4 of a fragmentary portion of my utensil depicting its receptacle with sections broken away.
Figure 5A:
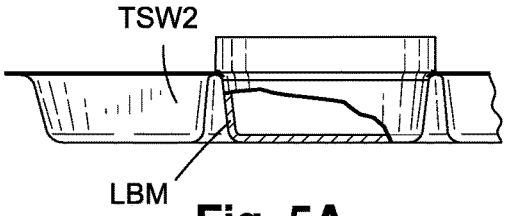
FIG. 5A is a right side elevation view like FIG. 5 of a fragmentary portion of my utensil depicting its receptacle with sections broken away.
Figure 5:
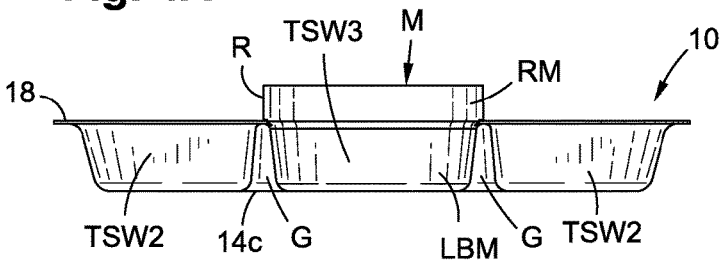
FIG. 5 is a right side elevation view of my tray utensil shown in FIG. 14.

As illustrated in FIGS. 1, 2 and 4, the pair of receptacles R have identical dimensions and are aligned and spaced apart along the central longitudinal reference line RL with one receptacle imbedded and integral in each opposed sides of the pair 14*b* of the rectangular member 12. As best illustrated in FIG. 8, each receptacle R includes a lower body member LBM configured to hold the standard beverage can SBC upright generally vertically while the tray utensil is oriented generally horizontally. The lower body member LBM and a side 14*b* are configured to form an arch structure best illustrated in FIG. 8A that imparts rigidity to the connection attaching the receptacle R to the tray member 12. Thus the connection is more durable than the connection disclosed in my pending U.S. Provisional Patent Application No. 62/640,564.

As best shown in FIG. 8A, the lower body member LBM is a truncated conical structure including an inwardly tapering sidewall TSW3 terminating in a generally flat bottom wall BW. The lower body member LBM is at least partially within the perimeter member 18 of the sunken rectangular central section 16. In the illustrated embodiment at least half of the lower body member LBM of each receptacle R is formed from the tapering sidewall TSW3 of the lower body member LBM. As shown in FIG. 2, the remainder of the lower body member LBM includes an outboard portion OP and inward portion IP comprising tapering sidewall TSW3. The inwardly tapering sidewall TSW2 of the sunken section 16 and the inwardly tapering truncated conical sidewall TSW3 are opposed to form between them a generally semi-circular groove G having an arch shaped cross-section as illustrated in FIG. 8A. The sidewalls TSW2 and TSW3 forming the arched shape groove G and the indentation IND are concentric around a center C lying along the central longitudinal reference line RL of the tray member 10.

Figure 9:
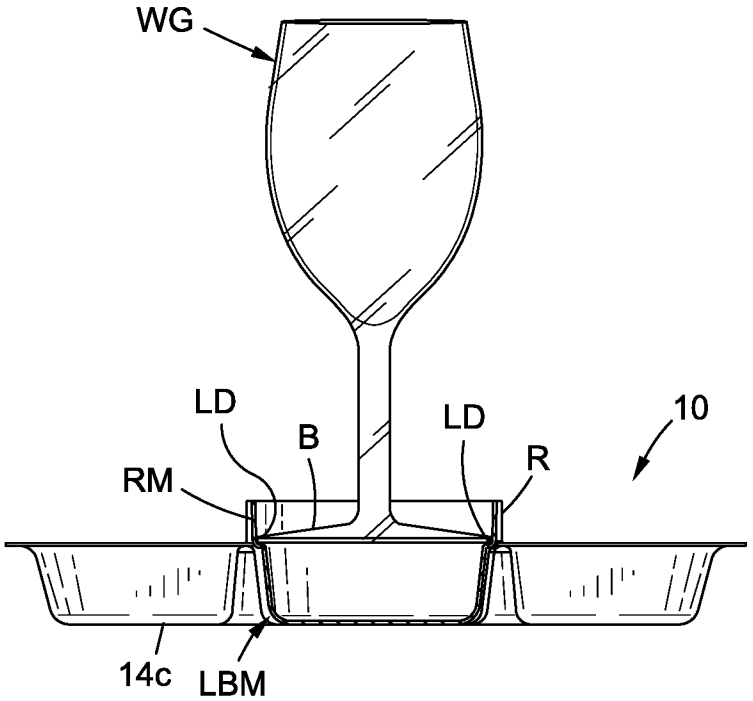
FIG. 9 is a cross-sectional view taken along line 9-9 of FIG. 2 with a wine glass partially inserted into a receptacle of my tray utensil.

Each receptacle R includes a cylindrical rim member RM having an outer circular edge terminating as an open mouth M and at an inner edge ED2 terminating in a circular ledge LD formed in, or connected to, an outer edge ED3 (FIG. 8) of the tapering sidewall TSW3. The open mouth M has a nominal diameter in excess of 2.5. This enables a current sized standard beverage can SBC to be inserted through the rim member RM into the lower body member LBM of one of the receptacles R. As best shown in FIGS. 1B, 2, and 9, the ledge LD is circular with a diameter less than the diameter of the circular diameter of the rim member RM and greater than the standard beverage can's diameter. For example, the rim member RM comprises a cylindrical wall CW with a height $h_2$ ranging from ¼ to ¾ inch, for example, ½ inch. The tapering sidewall TSW3 has a height $h_3$ ranging from ¾ to 1.25 inches, for example, 1 inch, and is tapered at an angle A from ½ to 3 degrees. The depth $d_1$ (FIGS. 7 and 8) of each receptacle R is established by the height $h_2$ of the cylindrical wall CW plus the height $h_3$ of the tapering sidewall TSW3. The depth is at least 1.25 inch and ranges from 1.25 to 2 inch. These dimensions are important because they accommodate both a conventional 12 oz. can and a conventional 16 oz. bottle, allowing a standard beverage can to be received within a receptacle R as illustrated in FIG. 8. As illustrated in FIG. 9, the ledge LD, however, restricts an item such as a wine glass WG from being inserted into a receptacle R. The circular base B of the wine glass WG has a diameter less than the circular diameter of the rim member RM and greater than the can's diameter, so the wine glass cannot be held upright in a receptacle.

Figure 3A:
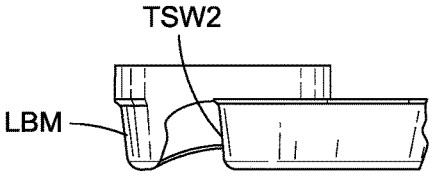
FIG. 3A is a front elevation view like FIG. 3 of a fragmentary portion of my utensil depicting its receptacle with sections broken away.
Figure 3:
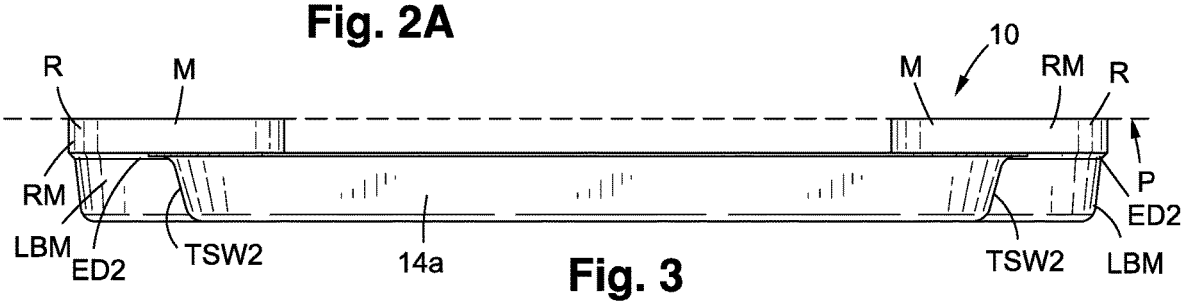
FIG. 3 is a front elevation view of my tray utensil shown in FIG. 1.

Each receptacle R is at least partially inboard of the perimeter member 18, and is integral with a side 14*b* of the rectangular member 12. Each receptacle R has a closed bottom wall BW, a tapering sidewall TSW3, and a circular open mouth M with a cylindrical rim RM (FIG. 4) abutting and integral with the rectangular perimeter member 18. The tapering sidewall TSW2 extends downward from a lower edge of the rim RM to the bottom wall BW. This elevates the open mouths M above the rectangular member 12, in this case, about a ½ inch. Each rim RM is elevated the same distance above the rectangular perimeter member 18 so that the open mouths M of the receptacles lie in a single reference plane P (FIG. 3).

Figure 12:
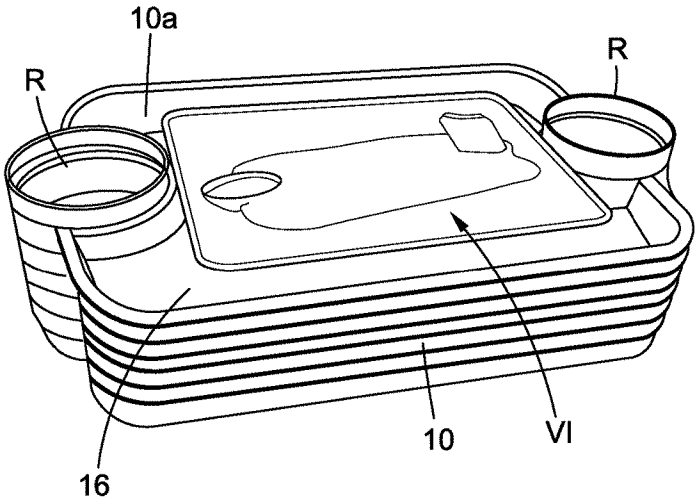
FIG. 12 is a perspective view of the tray utensil package shown in FIG. 11.
Figure 11:
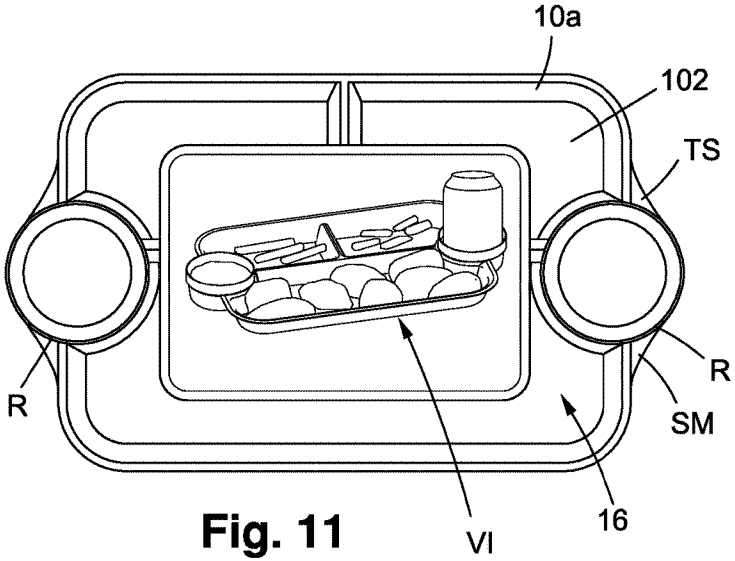
FIG. 11 is a top plan view of a package of my tray utensils shown in FIG. 1.
Figure 13:
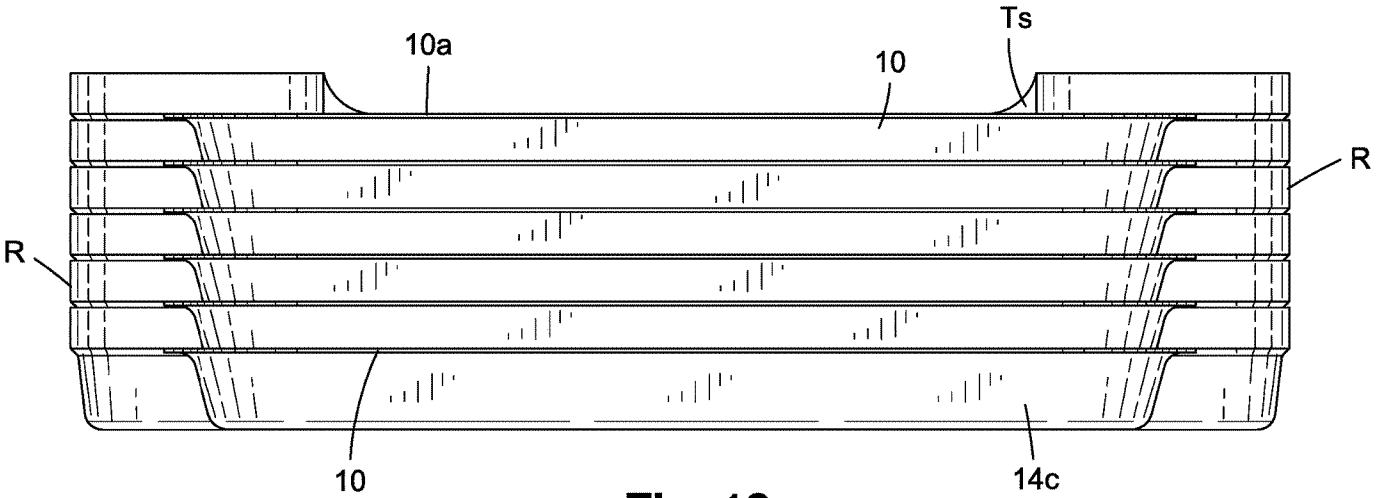
FIG. 13 is a side view of the tray utensil package shown in FIG. 11.

The tray utensils 10 are configured to enable utensils having identical dimensions to be stacked together into an assembly as illustrated in in FIGS. 11 through 13. The stack typically comprises from 6 to 12 trays that are shrink wrapped entirely within a transparent sheet TS. A top most tray 10*a* displays a visual image VI of a tray to holding hors d'oeuvres and within a tray receptacle a standard beverage can SBC. The visual image VI depicts the standard beverage can SBC upright, generally vertically oriented, while the tray is oriented horizontally. For example, a removable, separate, instruction sheet having the visual image VI printed thereon is placed on the topmost tray 10*a* prior to wrapping in the transparent sheet TS positioned to be viewed by a potential user through the transparent sheet TS. Alternately, a sticker type label displaying the visual image VI may be glued to the top most tray 10*a*.

SCOPE OF THE INVENTION

The above presents a description of the best mode I contemplate of carrying out my tray utensil, package of trays, and method, and of the manner and process of making and using them in such full, clear, concise, and exact terms as to enable a person skilled in the art to make and use. My tray utensil, package of tray utensils, and method are, however, susceptible to modifications and alternate constructions from the illustrative embodiment discussed above which are fully equivalent. Consequently, it is not my intention to limit my tray utensil, package of tray utensils, and method to the particular embodiment disclosed. On the contrary, my intention is to cover all modifications and alternate constructions coming within the spirit and scope of my tray utensil, package of tray utensils, and method as generally expressed by the following claims, which particularly point out and distinctly claim the subject matter of my invention:

The invention claimed is:

1. A tray utensil for holding hors d'oeuvres comprising a rectangular tray member for holding hors d'oeuvres having a central longitudinal reference line, opposed tapered sides, and an enlarged, sunken, rectangular, central section in which hors d'oeuvres are deposited, said sunken rectangular central section having a predetermined depth not exceeding 1.25 inch, a thin rectangular perimeter member along an upper edge of the sunken rectangular central section, said perimeter member at least partially surrounding the sunken rectangular central section, a linear divider member positioned lengthwise within the sunken rectangular central section between the opposed sides to form a food compartment on each side of the divider member, said divider member having a height equal to the predetermined depth of the central section and extending from one opposed side to the other opposed side and from a bottom of the central section to the upper edge of the sunken rectangular, and a pair of generally cylindrical receptacles integral with a sidewall forming the rectangular member, each receptacle of the pair having a closed bottom, a tapered sidewall, and a circular open mouth with the same diameter of 2.5 inch plus or minus 0.125 inch tolerance, and a depth from 1.25 inch to 1.75 inch, each receptacle is at an edge of the rectangular perimeter member and the open mouth of each receptacle elevated the same distance above the rectangular perimeter member so that the open mouths of the receptacles lie in a single reference plane, with one receptacle on each opposed side of the rectangular member and disposed along the central longitudinal reference line, said rectangular member having a width from 8 to 12 inches and a length from 8 to 12 inches, the sunken, rectangular, central section having a depth of from ¾ inch to 1.25 inch, and a generally rectangular perimeter member along an upper edge of the rectangular member having a width from ¼ inch to ¾ inch, said open mouths of the receptacles elevated above the rectangular perimeter member a distance the from ¼ inch to ¾ inch.

2. The utensil of claim 1 where said tray is a unitary structure having a thickness a thickness from 0.05 inch to 0.10 inch.

3. A tray utensil for holding hors d'oeuvres comprising a rectangular tray member for holding hors d'oeuvres having a central longitudinal reference line, opposed tapered sides, and an enlarged, sunken, rectangular, central section having a predetermined depth in which hors d'oeuvres are deposited, a rectangular perimeter member along an upper edge of the sunken rectangular central section, said perimeter member at least partially surrounding the sunken rectangular central section, a linear divider member positioned lengthwise within the sunken rectangular central section between the opposed sides to form a food compartment on each side of the divider member, said divider member having a height equal to the predetermined depth of the central section and extending from one opposed side to the other opposed side and from a bottom of the central section to the upper edge of the sunken rectangular, and a pair of generally cylindrical receptacles integral with a sidewall forming the rectangular member, each receptacle of the pair having a closed bottom, a tapered sidewall, and a circular open mouth, the circular open mouth of each one of the pair being of equal diameter, each receptacle being at an edge of the rectangular perimeter member and the open mouth of each receptacle elevated the same distance above the rectangular perimeter member so that the open mouths of the receptacles lie in a single reference plane, with one receptacle on each opposed side of the rectangular member and disposed along the central longitudinal reference line, said tray utensil being a unitary structure.

4. A tray utensil for holding hors d'oeuvres comprising a tray member having a central longitudinal reference line and including a sidewall with inwardly tapering sides to facilitate stacking, said sidewall forming a sunken central section of a predetermined depth suitable for holding hors d'oeuvres deposited therein and inwardly tapering sides to facilitate stacking, said sidewall terminating in a perimeter member along an upper edge of the central section sidewall, said perimeter member at least partially surrounding the sunken central section and including a pair of indentations formed therein, each one of the indentations being in the shape of a portion of a circle and each indentation positioned opposite the other indentation along the central longitudinal reference line, and each one of the indentations being concentric around a center lying along the central longitudinal reference line, a pair of generally cylindrical receptacles of identical dimensions aligned and spaced apart along the central longitudinal reference line, each receptacle having a body member configured to hold a standard beverage can upright generally vertically while the tray utensil is oriented generally horizontally, each receptacle being imbedded in and integral with an opposed side of the tray member, and each receptacle including an inwardly tapering lower side positioned in each indentation adjacent the central section sidewall and integral therewith, the inwardly tapering side of the central section sidewall and the inwardly tapering side of one receptacle being opposed and joining at said perimeter member to form there between a groove having in cross-section an arch shape.

5. The tray utensil of claim 4 where the receptacles have identical dimensions, the tray member is rectangular, and the open mouth of each receptacle is elevated the same distance above the perimeter member so that the open mouths of the receptacles lie in a single reference plane.

6. The tray utensil of claim 5 where a divider member is positioned lengthwise within the sunken central section between the opposed sides to form a food compartment on each side of the divider member, said divider member having a height equal to said predetermined depth of the central section and extending from one opposed side to the other opposed side and from a bottom of the central section to the upper edge of the sunken central section.

* * * * *